United States Patent [19]

Buchmüller

[11] 4,440,117

[45] Apr. 3, 1984

[54] ENGINE BLOCK FOR A WATER-COOLED INTERNAL COMBUSTION ENGINE

[75] Inventor: Günter Buchmüller, Wolfsburg, Fed. Rep. of Germany

[73] Assignee: Volkswagenwerk AG, Wolfsburg, Fed. Rep. of Germany

[21] Appl. No.: 363,552

[22] Filed: Mar. 30, 1982

[30] Foreign Application Priority Data

Apr. 18, 1981 [DE] Fed. Rep. of Germany ..... 3115671

[51] Int. Cl.[3] ..... F01P 3/02

[52] U.S. Cl. ..... 123/41.72; 123/41.84

[58] Field of Search ..... 123/41.72, 41.75, 41.76, 123/41.85, 41.84, 41.82 A

[56] References Cited

U.S. PATENT DOCUMENTS

| | | | |
|---|---|---|---|
| 1,763,664 | 6/1930 | Lonas | 123/41.72 |
| 2,739,579 | 3/1956 | Ware et al. | 123/41.82 A |
| 3,168,081 | 2/1965 | Bauer | 123/41.84 |
| 3,897,770 | 8/1975 | Mettig et al. | 123/41.83 |
| 4,092,956 | 6/1978 | List et al. | 123/41.82 R |
| 4,244,330 | 1/1981 | Baugh et al. | 123/41.84 |

FOREIGN PATENT DOCUMENTS 2501605 7/1975 Fed. Rep. of Germany .

*Primary Examiner*—William A. Cuchlinski, Jr.
*Attorney, Agent, or Firm*—Spencer & Frank

[57] ABSTRACT

A water-cooled internal combustion engine includes a die-cast, single-piece engine block encompassing a cylinder head, a cylinder block and one part of a crankcase and coolant passages in the cylinder head and the cylinder block. The coolant passages are constituted by spaces open outwardly towards respective adjacent ends of the engine block as cast, and closures fitted in the engine block for sealing the coolant passages fluid-tight towards the outside.

9 Claims, 4 Drawing Figures

ENGINE BLOCK FOR A WATER-COOLED INTERNAL COMBUSTION ENGINE

BACKGROUND OF THE INVENTION

This invention relates to an engine block for a water-cooled internal combustion engine, having a one-piece, die-cast block component encompassing the cylinder head, the cylinder block and one part of the crankcase.

In order to reduce manufacturing costs, the number of components and the cost of assembly, it has been known to make the engine block of a single light metal cast component, particularly a die-cast component which encompasses the cylinder head, the cylinder block and that part of the crankcase which is associated with the cylinders. Such an arrangement is disclosed in German Offenlegungsschrift (Application Published before Examination) No. 2,501,605. Since the conventional technology has not found it feasible to provide in such an engine block liquid coolant passages in that zone about the cylinders which is situated underneath the intake and exhaust conduits—in view of the fact that a removal of the casting core has not been considered possible—in those zones of the cylinder block a wall portion with cooling ribs has been provided. The purpose of such a ribbed wall is to transfer the heat generated in the cylinder, to the coolant passages and to the ambient atmosphere. These measures, however, do not ensure a uniform cooling of the cylinder wall along its circumference; this circumstance may lead to adverse thermal conditions during the operation of the engine.

SUMMARY OF THE INVENTION

It is an object of the invention to provide a one-piece engine block of the above-outlined type which includes liquid coolant passages entirely surrounding the cylinders so that a uniform heat removal is ensured over the entire circumference of the cylinders.

This object and others to become apparent as the specification progresses, are accomplished by the invention, according to which, briefly stated, the coolant passages associated with the cylinder head and the cylinder block are open towards the ends of the block as cast, and are sealed in the direction of the ends of the engine block by separate liquid-tight closures.

Thus, according to the invention, the coolant passages associated with the cylinder head and the cylinder block are formed, during casting, with the aid of separated cores which may be removed from the two ends of the engine block, that is, from the side of the crankcase and from the side of the valve drive. The liquid-tight sealing of the coolant passages is effected by the provision of closures subsequently inserted in the engine block, whereby preferably one of the closures is an annular member held between the outer wall face of the cylinder proper and an inner wall face of the cylinder block. Preferably, the cylinder proper is a cylinder sleeve cast or mounted in the engine block.

According to a further feature of the invention, the closure inserted at the end of the engine block where the valve drive is located, supports the bearing block for the rocker arm shaft and is centered with respect to the valve guide sleeves supported in the cylinder head.

Further, the engine block structure according to the invention is particularly well adapted for opposed two-cylinder, four-cycle engines where the engine blocks associated with the repective cylinders are offset relative to the crankshaft. In order to be able to use, for both cylinders identical one-component engine blocks and nevertheless ensure a relatively short distance for both crankshaft bearings, according to the invention each engine block contains an integral bearing bracket only for the bearing which is mounted on that end of the crankshaft which is oriented away from the crank stub associated with the respective engine block and further, on the bearing bracket a loose bearing cap is supported. By means of such a construction of the crankshaft bearing, wherein the bearings adjoining the crank stub have a loose bearing cap on the side of the engine block oriented towards the crank stub, the bearings can be placed very closely to the crank faces without endangering the die-cast manufacture of the engine block. The bearing cap may be affixed to the engine block by means of securing screws passing through the bearing bracket, so that during assembly of the engine the bearing cap is pulled against the bearing bracket by the securing screws.

In order to guide the loose bearing cap during such assembly, each engine block has, on its side facing the bearing bracket, at least in the zone of the parting plane situated at the height level of the crankshaft axis, guide ribs which extend into recesses provided in the circumference of the respective bearing cap.

DESCRIPTION OF THE PREFERRED EMBODIMENTS

Figure 1:
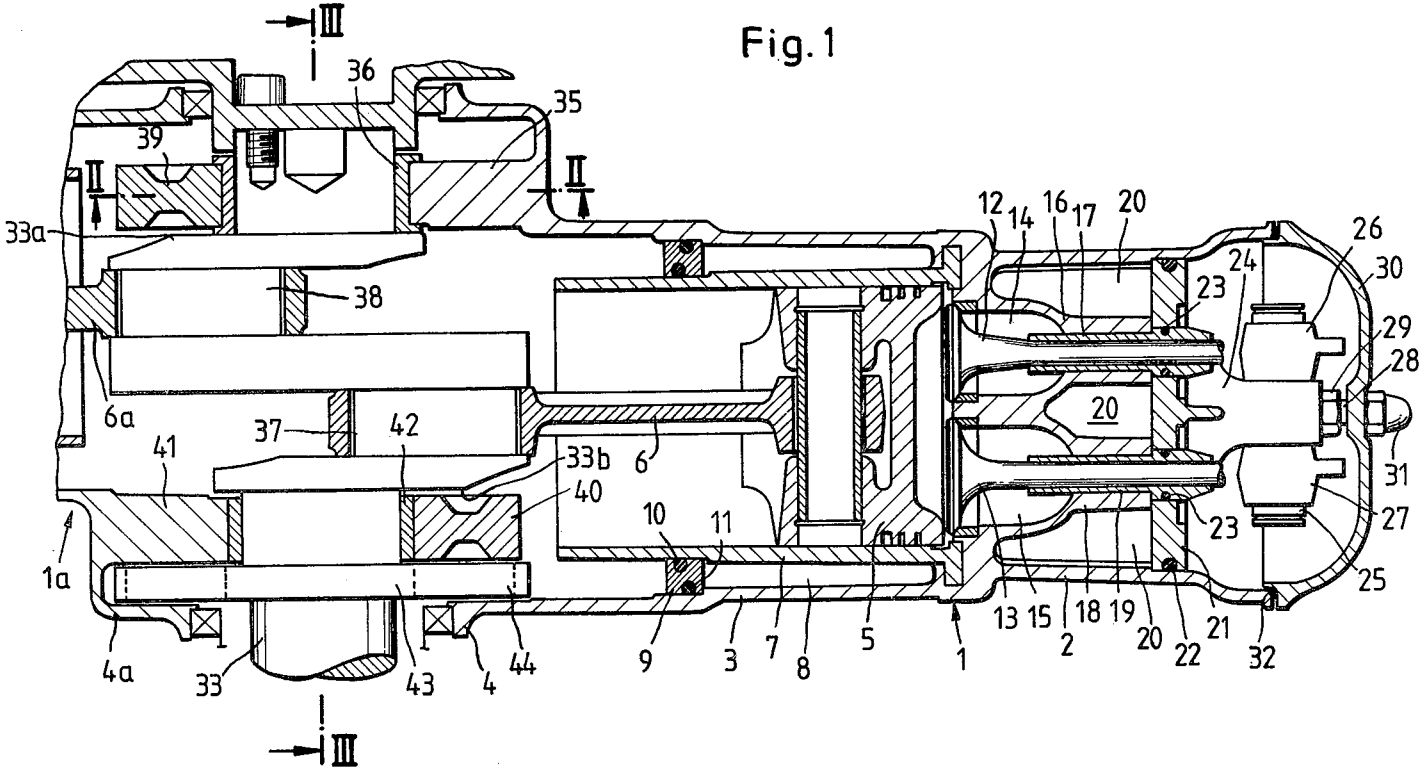
FIG. 1 is a longitudinal sectional view along a plane passing through one side of an opposed two-cylinder, four-cycle internal combustion engine incorporating a preferred embodiment of the invention.

Turning now to FIG. 1, there is shown an engine block generally designated at 1 which is a one-piece die-cast component and which includes a cylinder head 2, a cylinder block 3 and a portion 4 of the engine crankcase. In the opposed two-cylinder, four-cycle internal combustion engine, shown by way of example in FIG. 1, opposite the engine block 1 there is situated another engine block **1*a* which is of identical configuration and which is offset 180° with respect to the engine block 1**.

Figure 4:
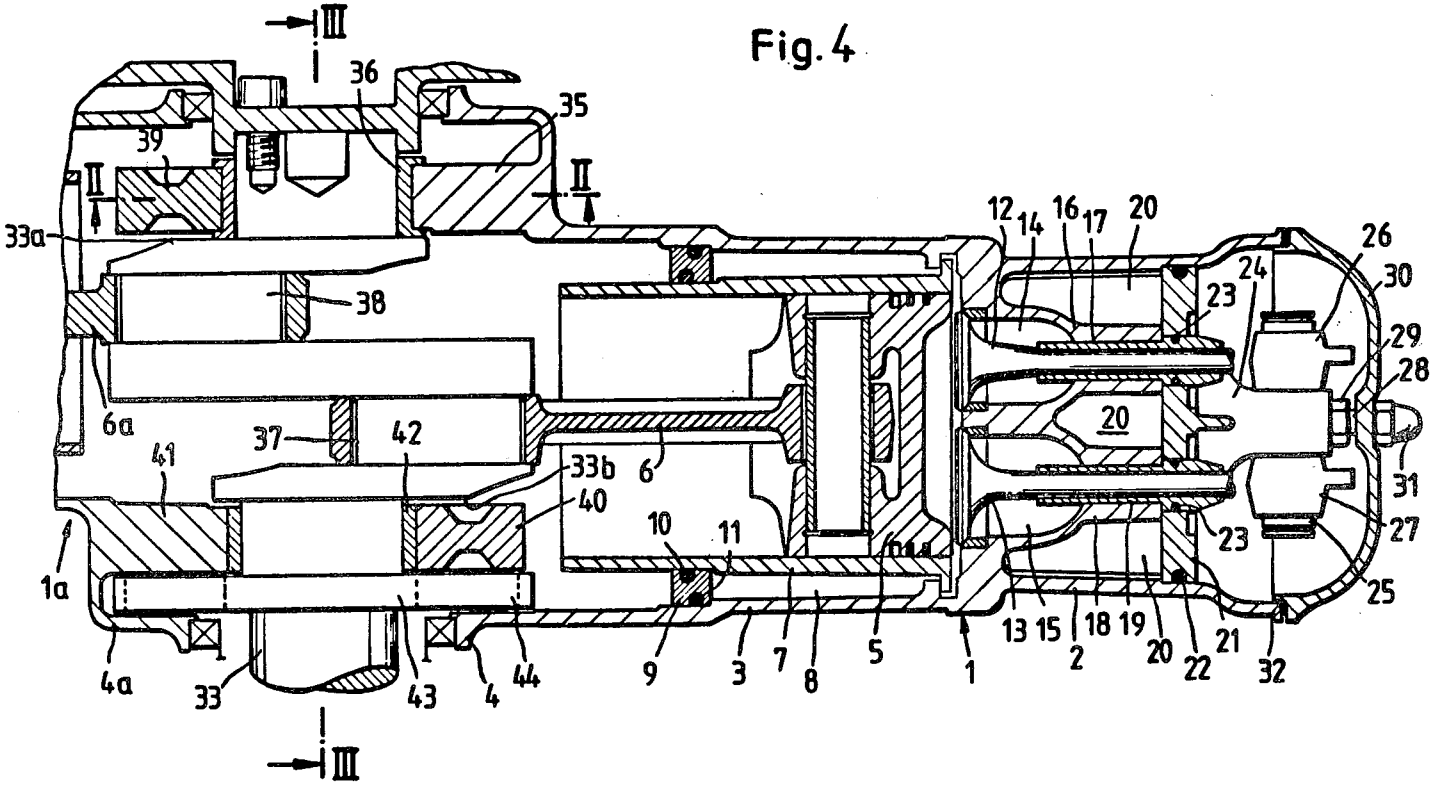
FIG. 4 is a longitudinal sectional view along a plane passing through one side of an opposed two-cylinder, four-cycle internal combustion engine incorporating another preferred embodiment of the invention.

The cylinder block 3 of the engine block 1 has a cylinder sleeve 7 which slidably receives a piston 5 which, in turn, is articulated to a crank stub 37 of a crankshaft 33 by means of a connecting rod 6. The cylinder sleeve 7 may be a cast-in component, as shown in FIG. 1, or may be inserted into the engine block as a separate, pre-fabricated part, as shown in FIG. 4, or may be cast with the engine block as a single piece. Regardless of the method with which the cylinder sleeve 7 is provided in the engine block, it is of importance that the coolant passage 8 provided between the cylinder sleeve 7 and the wall of the cylinder block 3 is open towards the crankcase, so that the core which occupies and thus forms the passage 8 during the die-casting may be removed in the direction of the space defined by the crankcase housing. After the core is so removed subsequent to casting, the coolant passage 8 is sealed by an annular closure 9 which, by means of O-rings 10 and 11 is fitted between the outer wall face of the cylinder sleeve 7 and the inner contour of the cylinder block 3 is a fluidtight manner. The coolant intake and outlet is situated, for example, at one of the ends of the engine block and is not shown in FIG. 1.

In the cylinder head 2 intake and exhaust channels 14 and 15 are formed which extend essentially at an angle to the axis of the piston 5 and which are controlled in a conventional manner by intake and exhaust valves 12 and 13, respectively. The intake and exhaust channels 14 and 15 as well as the valve guiding sleeves 17 and 19 held in respective cylinder head eyelets 16 and 18 are surrounded by a coolant passage 20 which is open towards the valve-side end of the engine block 1 so that the core occupying and thus forming the space 20 during the die-casting of the one-piece engine block 1 may be removed in the direction of the valve-side end of the engine block. The sealing of the coolant passage 20 is effected by a closure 21 which is inserted into the engine block and which is centered with respect to the valve guiding sleeves 17 and 19 of the respective valves 12 and 13 and which is fitted in the outer wall of the engine block 1. Seals 22, as well as O-rings 23 render the closure 21 liquidtight. The closure 21 lies on the end faces of the eyelets 16 and 18 of the engine block 1 and is secured by means of a tensioning anchor 28 which passes through a bearing block 24 for a rocker arm shaft 25 provided for the drive of the valves 12 and 13 and which is anchored in a conventional manner in the engine block 1. The bearing block 24 is secured by means of a nut 29 mounted on the upper end of the tensioning anchor 28 while another nut 31 positions an engine block closure 30, which may be a cast or a sheet component, on the engine block 1 with the interposition of a seal 32.

On the rocker arm shaft 25 there are swingably supported rocker arms 26 and 27 for actuating the respective valves 12 and 13. The rocker arms 26 and 27 are, in turn, oscillated by reciprocating push rods moved, with the interposition of respective followers, by a camshaft situated underneath the crankshaft and rotated by a gear drive 43, 44.

The crankshaft bearings situated adjacent the two crank stubs 37 and 38 are so structured that stationary bearing brackets 35 and 41, which are integral parts of the engine blocks 1 and 1*a*, respectively, are provided only on one side of the respective bearing. Each engine block 1 and 1*a* has the bearing bracket (35 or 41 respectively) of that bearing which is mounted on the end remote from the crank stub 37 or 38 associated with the respective engine block 1 or 1*a*. Thus, stated in more detail, the engine block 1 includes the integral bearing bracket 35 which supports the crankshaft bearing 36 mounted on the top end (as viewed in FIG. 1) of the crankshaft 33. Adjacent the top end of the crankshaft 33 there is situated the crank stub 38 which, however, is associated with the engine block 1*a*, since the crank stub 38 serves the piston (not shown) and its connecting rod 6*a* arranged in the engine block 1*a*. The crank stub 37, on the other hand, is associated with the engine block 1, since the crank stub 37 serves the piston 5 and its connecting rod 6 arranged in the engine block 1. Consequently, the bearing block 35 is remote from the crank stub 37. Similarly, the engine block 1*a* includes the integral bearing bracket 41 which supports the crankshaft bearing 42 mounted on the bottom end (as viewed in FIG. 1) of the crankshaft 33. For the same reasons as discussed in connection with the bearing bracket 35, the bearing bracket 41 is remote from the crank stub 38 associated with the engine block 1*a*.

Figure 2:
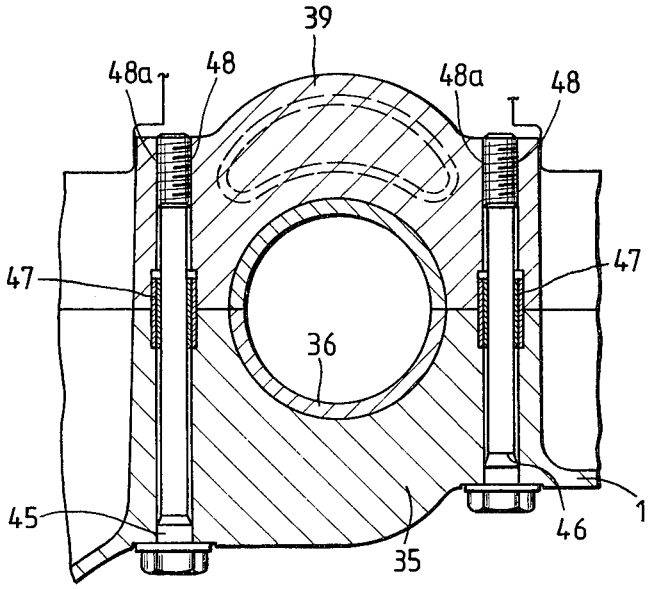
FIG. 2 is a sectional view taken along line II—II of FIG. 1 or FIG. 4.

The bearings supporting the crankshaft 33 are complemented by the respective bearing shells 36 and 42 as well as by respective bearing caps 39 and 40. As illustrated in more detail in FIG. 2, showing the top bearing for the crankshaft 33, as seen in FIG. 1, the bearing cap 39 is first loosely held on the bearing bracket 35 by bolts 45 and 46 passing through the bearing bracket 35. The same securing arrangement is provided for the bottom bearing which comprises the bearing bracket 41. By means of this arrangement of the bearing wherein on the side of the engine block which is associated with the adjoining crank stub there is provided a loose bearing cap, it is feasible to arrange the bearings in the immediate proximity of the outer crank arm faces 33*a* and 33*b*, respectively, so that the distance between the bearings can be very short. A bearing bracket which is integral with the engine block thus need not be provided in this zone underneath the cylinder sleeve 7 or the coolant passage 8, at least in case of a die-cast component.

With further reference to FIG. 2, the securing bolts 45 and 46 have at their end oriented towards the bearing cap 39, a thread 48 which engages a thread 48*a* provided in the bearing cap 39 and exerts tension thereon upon assembly of the bearing, whereby centering sleeves 47 provided in the parting plane ensure a reliable centering of the bearing cap.

Figure 3:
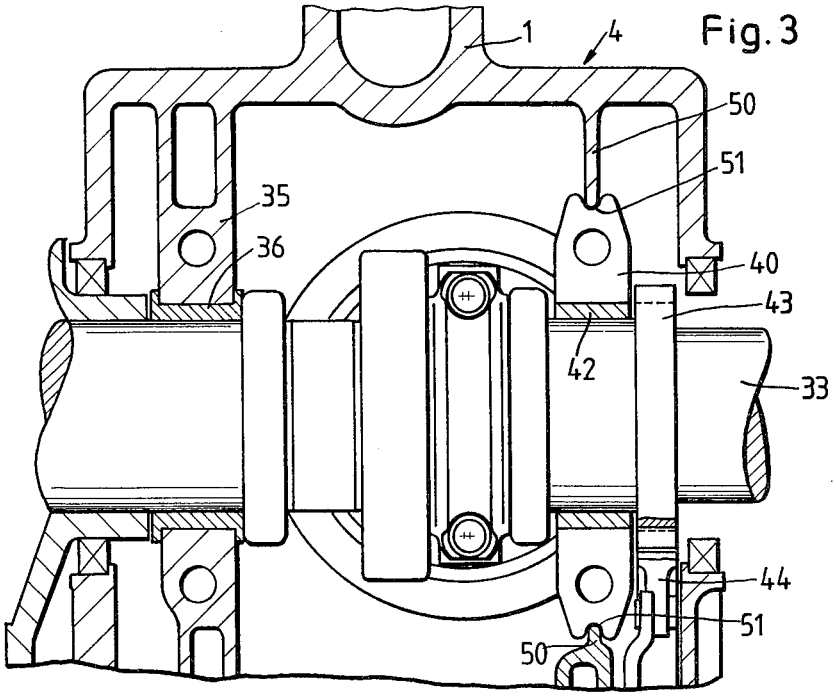
FIG. 3 is a fragmentary sectional view taken along line III—III or FIG. 1 or FIG. 4.

Turning now to FIG. 3, in order to ensure a proper guidance of the bearing caps 40 and 39 inserted first in a loose manner in the respective engine blocks 1 and 1*a*, the engine blocks have, at least in the zone of their parting plane, guide ribs 50 which extend into recesses 51 provided on the outer periphery of the respective bearing cap to thus hold the latter in the installed position.

According to the invention as described above in conjunction with the Figures, there is provided an engine block structure in which there is achieved a uniform cooling effect by a liquid coolant for both the cylinder block and the cylinder head despite the fact that a single-component die-cast engine block is provided which encompasses the cylinder head, the cylinder block and part of the crankcase. This result is made possible by the fact that the coolant passages are, in the cast component, open towards the sides thereof and are subsequently sealed by inserted closures. In case a cooling in the zone of the cylinder head underneath the intake channel 14 and particularly the exhaust channel 15 is not sufficient, a bore hole provided from the outside may interconnect the zones of the coolant passages 20 on either side of the channels. The openings of the bore hole are subsequently sealed in the zone of the outer wall of the cylinder head.

The particular construction of the crankshaft bearing, having, in each engine block, only one stationary bearing bracket on which a loose bearing cap is inserted makes possible to arrange the crankshaft bearings in the immediate vicinity of the crank stubs without adversely affecting the manufacture of the engine block in a die-cast process as well as the assembly of the engine. This applies particularly to opposed two-cylinder, four-cycle internal combustion engines which, as known, have a good balance of masses and which offer an optimal solution with their short structural length and two identical die-cast block components. The shape of the engine block may be so designed that it may find application for both engine sides without necessitating additional changes in the two components or in their machining. The use of identical engine block components for both engine sides substantially reduces the number of engine components as well as the investment costs in their manufacture.

It will be understood that the above description of the present invention is susceptible to various modifications, changes and adaptations, and the same are intended to be comprehended within the meaning and range of equivalents of the appended claims.

What is claimed is:

1. In a water-cooled internal combustion engine including a single-piece, die-cast engine block encompassing a cylinder head, a cylinder block and one part of a crankcase and means defining coolant passages in said cylinder head and said cylinder block, the improvement wherein said coolant passages are constituted by spaces open outwardly toward respective adjacent ends of the said engine block as cast, further comprising closure means fitted in said engine block for sealing said coolant passages fluidtight towards the outside.

2. An internal combustion engine as defined in claim 1, further comprising a cylinder secured in said engine block and having outer wall faces; said outer wall faces of said cylinder and inner wall faces of said cylinder block together defining an annular space surrounding said cylinder and constituting the coolant passage in said cylinder block; said closure means comprising an annular closure fitted fluid-tight between said outer wall faces of said cylinder and said inner wall faces of said cylinder block.

3. An internal combustion engine as defined in claim 2, wherein said cylinder is a cylinder sleeve cast into said cylinder block.

4. An internal combustion engine as defined in claim 2, wherein said cylinder is a cylinder sleeve mounted in said cylinder block.

5. An internal combustion engine as defined in claim 1, further comprising cylinder valves, rocker arms and a rocker arm shaft supported in said cylinder head, further wherein the closure means sealing the coolant passages in said cylinder head in a closure plate fitted in said cylinder head; further comprising a bearing bracket carried on said closure plate and supporting said rocker arm shaft.

6. An internal combustion engine as defined in claim 5, further comprising valve guiding sleeves supported in said cylinder head and slidably receiving respective said valves; said closure plate being centered relative to said valve guiding sleeves.

7. In a water cooled, opposed, two-cylinder, four-cycle internal combustion engine having two identical, single-piece first and second engine blocks, each encompassing a cylinder head, a cylinder block and one part of a crankcase, a sole crankshaft supported in the crankcase defined together by said first and second engine blocks, said crankshaft having first and second crank stubs; bearings supporting opposite ends of said crankshaft in said crankcase; a first cylinder mounted in said first engine block and slidably receiving a first piston, a first connecting rod articulating said first piston to said first crank stub, a second cylinder mounted in said second engine block and slidably receiving a second piston, a second connecting rod articulating said second piston to said second crank stub; and means defining coolant passages in said cylinder head and said cylinder block of said first and second engine blocks, the improvement wherein said coolant passages are constituted by a space open outwardly towards respective ends of said first and second engine blocks as cast, futher comprising closure means fitted in said first and second engine blocks for sealing said coolant passages towards the outside; said first and second engine blocks each having an integral first and second bearing bracket, respectively, for supporting said bearings; said first bearing block being situated at one end of said crankshaft remote from said first crank stub and said second bearing block being situated at another end of said crankshaft remote from said second cranks stub; further comprising first and second bearing caps tightenably supported on said first and second bearing brackets, respectively.

8. An internal combustion engine as defined in claim 7, further comprising securing bolts passing through the respective said bearing brackets and associated bearing caps for tightening the bearing caps to the bearing brackets.

9. An internal combustion engine as defined in claim 7, wherein said first and second engine blocks together define a parting plane; further comprising means defining recesses in circumferential portions of each said bearing cap and guide ribs integral with each said engine block; said guide ribs projecting into said recesses for guiding and positioning said bearing caps.

* * * * *